114-242
6/9/81
SR
XR 4,271,550

United States Patent [19]

Joubert et al.

[11] 4,271,550

[45] Jun. 9, 1981

[54] METHOD FOR SUBMERGING AN EQUIPMENT OF NEGATIVE BUOYANCY

[75] Inventors: Philippe Joubert, Les Loges en Josas; Pierre Durando, Paris; Daniel Fleury, Nantes, all of France

[73] Assignee: Institut Francais du Petrole, France

[21] Appl. No.: 907,192

[22] Filed: May 18, 1978

[30] Foreign Application Priority Data

May 26, 1977 [FR] France ..... 77 16451

[51] Int. Cl.[3] ..... B63B 21/52

[52] U.S. Cl. ..... 9/8 R; 114/242; 114/293; 405/171

[58] Field of Search ..... 9/8.5, 9.8 R; 114/116, 114/242, 243, 244, 245, 253, 254, 293; 405/154, 158, 162, 171, 172

[56] References Cited

U.S. PATENT DOCUMENTS

| | | | |
|---|---|---|---|
| 2,783,027 | 2/1957 | Gilbert | 9/8 R X |
| 2,908,141 | 10/1959 | Marsh, Jr. | 114/293 X |
| 3,173,271 | 3/1965 | Wittgenstein | 114/245 X |
| 3,566,426 | 3/1971 | Davidson et al. | 9/9 |
| 3,613,616 | 10/1971 | Basset | 9/9 X |
| 3,657,752 | 4/1972 | Davidson et al. | 9/9 |
| 3,667,417 | 6/1972 | Clinkenbeard | 9/9 X |
| 4,048,686 | 9/1977 | Ege | 405/171 |
| 4,063,430 | 12/1977 | Lamy | 405/171 |

FOREIGN PATENT DOCUMENTS

| | | | |
|---|---|---|---|
| 865454 | 3/1971 | Canada | 9/8 R |
| 1434357 | 5/1976 | United Kingdom | 405/171 |

*Primary Examiner*—George E. A. Halvosa
*Attorney, Agent, or Firm*—Craig and Antonelli

[57] ABSTRACT

The equipment is connected through a line to an auxiliary buoyant element to form an assembly of positive buoyancy, the equipment to be submerged and the auxiliary element being at first held in spaced relationship. The equipment is thereafter dropped into water, the length of the connecting line being so limited that the equipment then becomes suspended in water under the auxiliary element without reaching the water bottom. The location of the assembly is then optionally adjusted, and its buoyancy is reduced to a negative value.

7 Claims, 12 Drawing Figures

METHOD FOR SUBMERGING AN EQUIPMENT OF NEGATIVE BUOYANCY

The present invention relates to a method for laying onto a precise location of the water bottom a heavy equipment of positive apparent weight in water, i.e. an equipment of negative buoyancy.

In the following, heavy equipments will designate mooring masses as well as assemblies of heavy and buoyant elements, provided that these assemblies have a negative buoyancy.

Submerging mooring masses is, for example, carried out in the course of offshore operations, or also to form anchoring members for elements, equipments or installations of positive buoyancy, such as for example floating surface installations (ships, drilling platforms, barges, floating pontoons, buoys, etc. . . . ), or buoyant elements which are kept submerged for various particular reasons, such elements, equipments, or installations being connected to the mooring masses through mooring or anchoring lines.

The size and weight of such mooring masses or heavy elements will be selected in accordance with each particular application and may reach very high values. For example, anchoring a drilling platform requires submerging at separate locations about ten mooring masses whose real weight may reach 200 tons or more for each mooring mass.

The methods used, up to now, to submerge heavy equipments, require surface installations whose size increases with an increasing weight of these equipments.

A further problem is that of accurately positioning such heavy equipments.

The method according to the invention permits a precise positioning of heavy equipments such as mooring masses, irrespective of their weight, all the steps of this method being carried out without requiring any large-sized surface installations. This method is simple and can be carried out rapidly.

Figure 1:
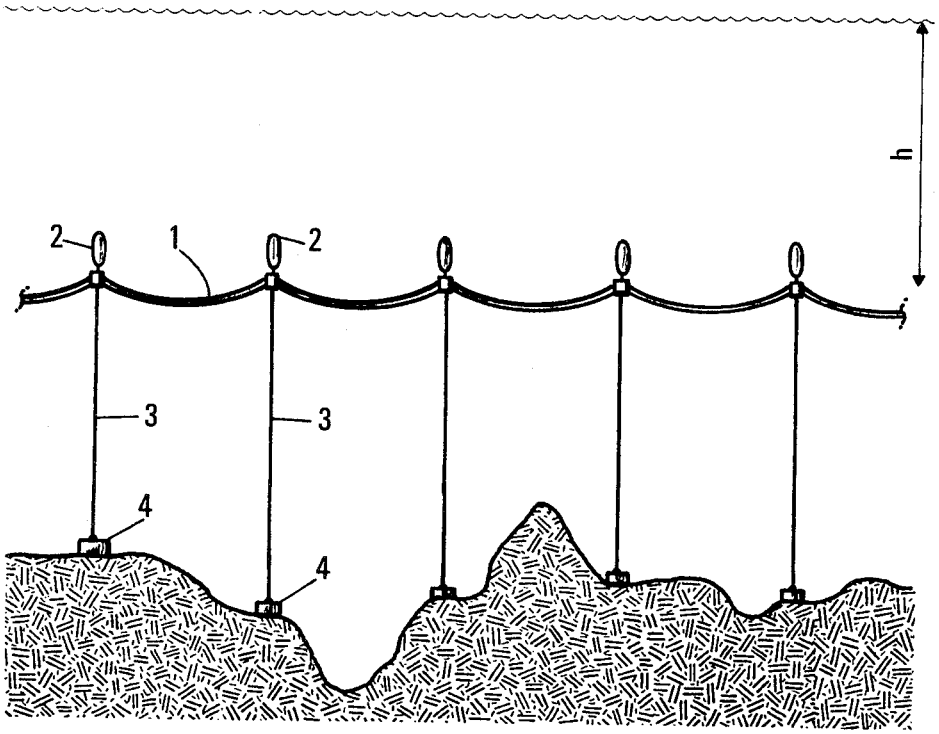
Figure 2:
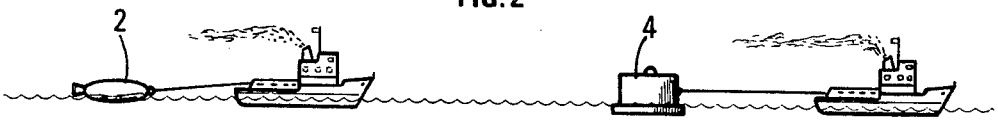
Figure 3:
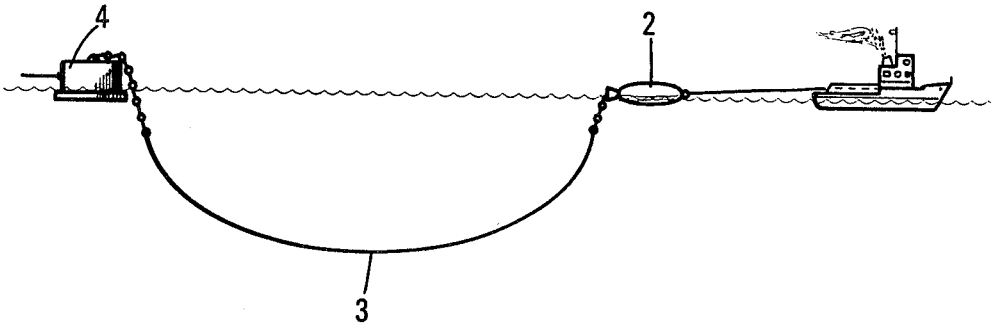
Figure 4:
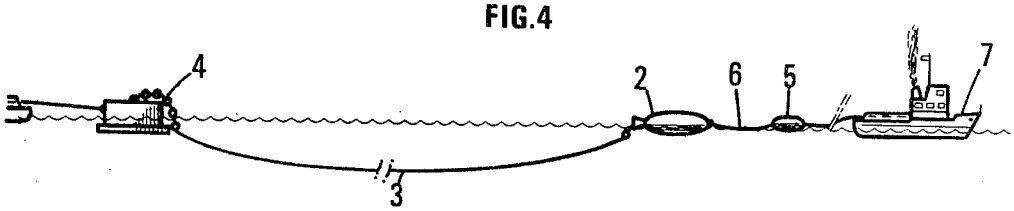
Figure 5:
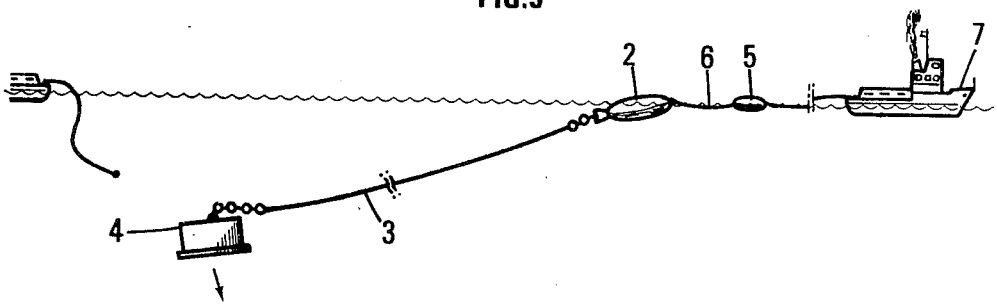
Figure 6:
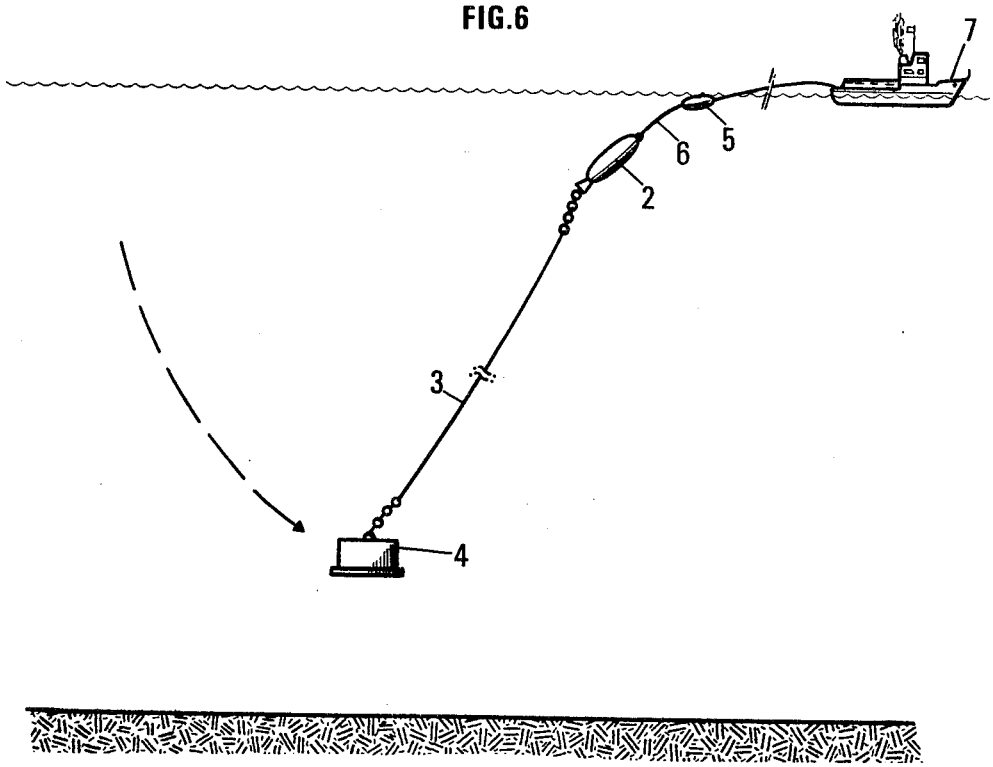
Figure 9:
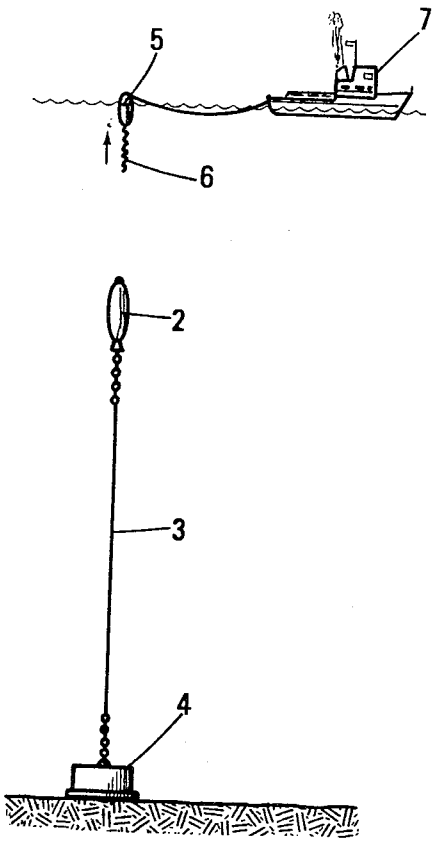
Figure 8:
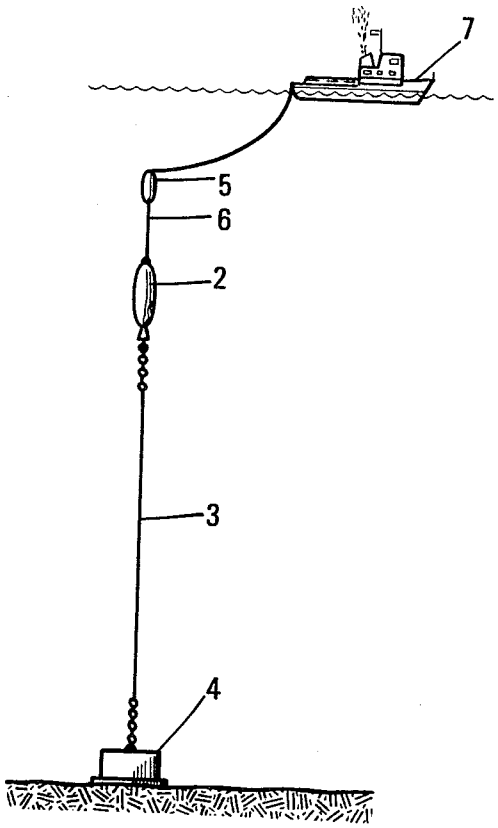
Figure 7:
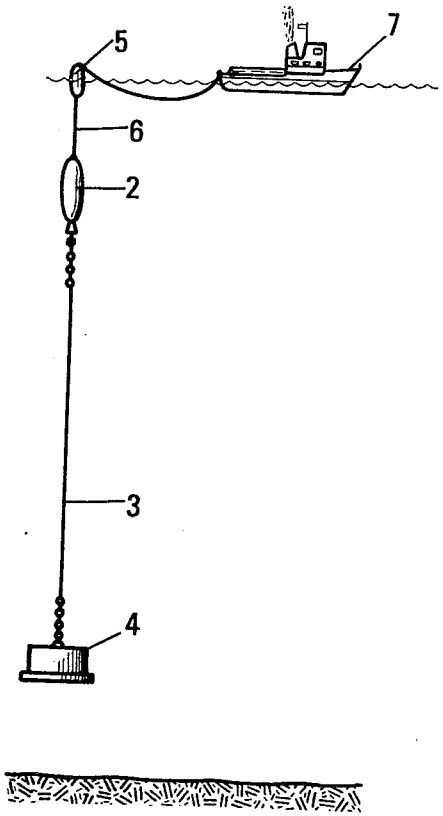
Figure 10:
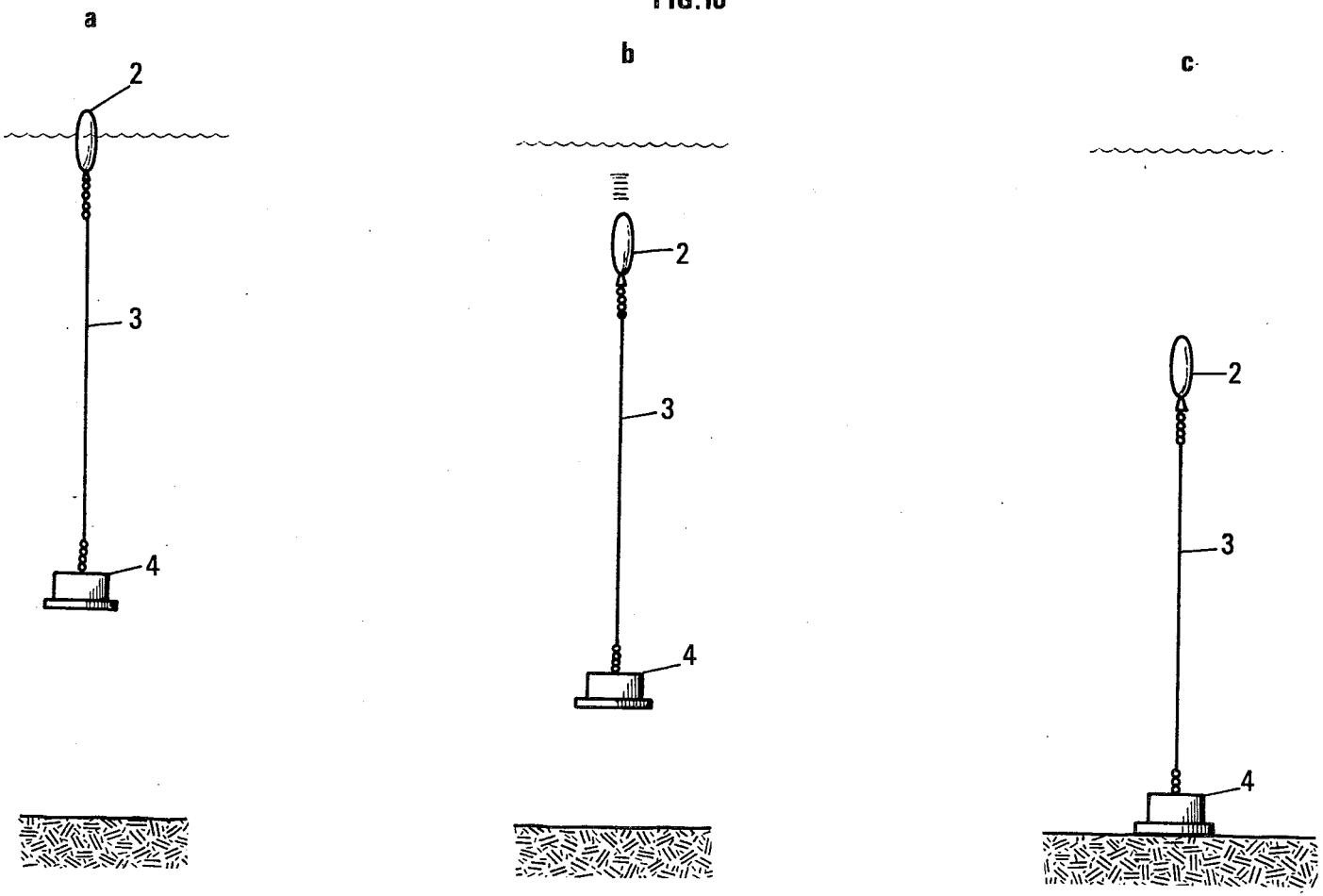

The invention will be better understood and its advantages made apparent from the following description illustrated by the accompanying drawings wherein:

FIG. 1 diagrammatically illustrates, by way of non-limitative example, the accurate positioning, on the water bottom, of mooring masses destined to keep submerged elements of positive buoyancy locally supporting a flow line used for conveying a fluid through a liquid body, FIGS. 2 to 10 illustrate different steps of the method according to the invention, FIG. 1 shows, by way of example, the application to accurate positioning of heavy members on the water bottom.

These heavy members constitute mooring masses 4 to which are connected mooring lines 3 to keep submerged buoyant elements 2 which locally support a flexible pipe 1.

Owing to its submerged position, pipe 1, which is of a type suitable for conveying a fluid such as hydrocarbons, is partly or fully protected against the action of external forces which may for example be generated by wind, heave . . . etc. . . . Moreover, submerging flexible pipe 1 clears the water surface or the immediate vicinity thereof and particularly the spaces devoted to navigation.

The actual profile of flexible pipe 1 depends, among other things, on the position of the different heavy members or mooring masses 4 to be accurately positioned in spite of their heavy weight, reaching or even exceeding 200 metric tons in the considered application.

This problem is solved in a simple manner by the method according to the invention which comprises the following steps of:

(a) connecting the heavy equipment constituted by heavy member 4 and buoyant element 2 to an auxiliary element, such as a buoy, through a line of such a length that the heavy member can be suspended from the auxiliary element without reaching the water bottom, the assembly of the heavy member and the auxiliary element having a non-negative overall buoyancy (i.e. a generally positive buoyancy without however excluding a zero buoyancy in some applications), (b) optionally adjusting the position of the auxiliary element to place it substantially above the site of immersion, (c) maintaining the heavy equipment at the water surface by using lightening means and preferably stretching the line which connects the heavy member to the auxiliary element, (d) interrupting the action of the lightening means and dropping the heavy member 4 so that it becomes immersed by the action of gravity, thereafter suppressing the action of the auxiliary element while controlling, if required, the location of the heavy equipment.

FIGS. 2 to 9 diagrammatically illustrate an embodiment of the invention comprising the following steps:

1. The floating element 2 and the heaver member 4 are brought to the site of utilization. This step can be carried out by towing the heavy member 4 (FIG. 2) after lightening it by any suitable means, for example by emptying ballasting chambers provided in said member or by associating auxiliary floats to this member during its transportation.
2. Anchoring line 3 of a selected length is connected both to member 4 and to buoyant element 2 (FIG. 3), the assembly 4-2 of the heavy member and the buoyant element constituting said heavy equipment having, in conditions of use, a negative buoyancy.
3. In order to increase its buoyancy, the heavy member 4 is connected (FIG. 4) to an auxiliary floating element or buoy 5, through a cable 6 such that the maximum possible distance between floating element 5 and heavy member 4 is smaller, by at least about 20 meters, than the water depth at the location where the heavy equipment has to be immersed: floating element 5 is so selected as to give a positive buoyancy to the assembly formed by heavy member 4 and auxiliary floating element 5.
4. Preferably floating element 5 is positioned substantially above the selected site and a tension is applied to lines 6 and 3. Then the action of the lightening means is interrupted to reduce the buoyancy of heavy member 4, for example by ballasting it, if this member is equipped with ballasting chambers (FIG. 4).
5. The heavy member 4 is dropped and falls by gravity (FIGS. 5 and 6) until it is supported by floating element 5 which is located at the water surface at the end of this step (FIG. 7).
6. If necessary the position of the assembly is adjusted with respect to the selected location and the buoyancy of the floating element or buoy 5 is adjusted (FIG. 8) to such a value that the assembly formed by heavy member 4 and floating element 5 has a slightly negative buoyancy. This may be achieved, for example, by remotely actuating an electro-valve (not shown) through which a liquid of sufficient specific gravity, such as water, is introduced into buoy 5.

7. When heavy member 4 has reached the water bottom, cable 6 is disconnected from floating element 2 (FIG. 9) and buoy 5 rises back to the water surface so that it may be used again for positioning another heavy equipment.

By stretching lines 3 and 6 prior to releasing heavy member 4, too sudden variations in the tension of these lines may be avoided, which might result from a free falling of heavy member 4 suddenly stopped by said lines.

Disconnection of cable 6 from floating element 2 may be performed by a diver or by using a releasable connector, for example a hydraulic connector, an explosive connector . . . etc. . . .

Disconnection will preferably be performed when the buoyancy of buoy 5 has been reduced to a slightly positive value so that rising of this buoy is not too fast.

This method may obviously be used when the heavy equipment comprises a floating element such as 2, provided with means for adjusting its buoyancy up to a maximum value giving a positive buoyancy to the equipment.

In this case the floating element 2 has also the function of buoyant element 5. This element 2 is at first given its maximum buoyancy so that after heavy member 4 has been dropped and has fallen by gravity, this heavy member is supported by element 2 which floats at the water surface at the end of this operation (FIG. 10*a*). Then (not illustrated) control means (which may for instance comprise a flap valve) are actuated to introduce into floating element 2 a material such as water to reduce the buoyancy of this element to a minimum value lower than the apparent weight of heavy member 4, whereby can be progressively achieved the immersion of the heavy equipment (FIGS. 10*b* and 10*c*).

Floating element 5 may be a floating installation, such as a ship, a barge, a drilling-platform, etc. . . . provided this installation is capable of safely supporting the heavy equipment and comprises means for paying out cable 6 to increase the length thereof and thereby permit laying heavy member 4 onto the water bottom.

The cable 6, connecting heavy member 4 to floating element 5, may be a cable so designed as to withstand the stresses developed during the immersion of the heavy member, but it will be possible to use mooring or anchoring lines for the immersion of heavy members such as mooring masses.

What we claim is:

1. A method for submerging to a preselected location with respect to the water bottom a heavy equipment having in conditions of use a negative buoyancy and comprising at least one heavy element, this method comprising the steps of:

(a) connecting through a line the heavy equipment to auxiliary element means, the assembly formed by the heavy equipment and said auxiliary element means having a non-negative buoyancy, and maintaining the heavy equipment and the auxiliary element means in lateral spaced relationship, (b) positioning said auxiliary element means substantially above said preselected location, then subjecting the heavy equipment to the action of gravity by providing negative buoyancy thereto, the length of the connecting line being so limited that the heavy equipment then becomes suspended in water under said auxiliary element means substantially above said preselected location, without reaching the water bottom, (c) adjusting, if so required, the location of the heavy equipment with respect to said preselected location, and (d) reducing the buoyancy of said assembly to at least a slightly negative value, until said heavy equipment reaches said preselected location.

2. A method according to claim 1, comprising the step of disconnecting the heavy equipment from said auxiliary element means when the heavy equipment has been positioned at said preselected location.

3. A method according to claim 1, wherein, during step (a), the heavy equipment and the auxiliary element means are kept at such a distance from each other as to keep stretched said connecting line.

4. A method according to claim 1, including the step of providing lightening means with said heavy equipment to temporarily give the heavy equipment a positive buoyancy to facilitate transportation of said equipment on the water surface, step (b) of the method being carried out by cancelling the effect of said lightening means on the heavy equipment.

5. A method according to claim 1, wherein the buoyancy of said auxiliary element means is adjustable between two values at least one of which is positive, step (d) of the method being carried out by reducing the buoyancy of said auxiliary element means, and after said reducing disconnecting said auxiliary element means from the heavy equipment when the latter is at the site selected for immersion.

6. A method according to claim 5, including adjusting the buoyancy of said auxiliary element means to a slightly positive value before disconnecting said auxiliary element from the heavy equipment.

7. A method according to claim 1, wherein the heavy equipment also comprises a buoyant element having a buoyancy adjustable between a maximum value greater than the apparent weight of said heavy element in water and a minimum value lower than this apparent weight, said buoyant element being connected to the heavy equipment through an anchoring line, said auxiliary element means being formed by said buoyant element, the anchoring line having a length smaller than the water depth at the preselected location, the method being carried out by suitably adjusting the buoyancy of said buoyant element.

* * * * *